US012429232B2

(12) United States Patent
Park et al.

(10) Patent No.: US 12,429,232 B2
(45) Date of Patent: Sep. 30, 2025

(54) OUTDOOR UNIT OF AIR CONDITIONER

(71) Applicant: LG ELECTRONICS INC., Seoul (KR)

(72) Inventors: Kiyoon Park, Seoul (KR); Hyunwook Bae, Seoul (KR); Jonghae Lee, Seoul (KR); Gwansoo Lee, Seoul (KR); Taegyu Kim, Seoul (KR); Hyoungjune Kim, Seoul (KR); Junhee Kim, Seoul (KR); Siyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 156 days.

(21) Appl. No.: 18/378,341

(22) Filed: Oct. 10, 2023

(65) Prior Publication Data

US 2025/0020342 A1 Jan. 16, 2025

(30) Foreign Application Priority Data

Jul. 13, 2023 (KR) ..... 10-2023-0091330

(51) Int. Cl.
*F24F 1/06* (2011.01)
*F24D 3/18* (2006.01)
(Continued)

(52) U.S. Cl.
CPC ..... *F24F 1/06* (2013.01); *F24D 3/18* (2013.01); *F24F 1/26* (2013.01); *F24F 1/46* (2013.01);
(Continued)

(58) Field of Classification Search
CPC ..... F24F 1/06; F24F 1/14; F24F 1/16; F24F 1/26; F24F 1/28; F24F 1/30; F24F 1/32;
(Continued)

(56) References Cited

U.S. PATENT DOCUMENTS 5,775,119 A * 7/1998 Yamada ..... F24F 1/32 312/236
5,987,909 A * 11/1999 Martin, Sr. ..... F24F 13/222 62/291
(Continued)

FOREIGN PATENT DOCUMENTS

EP 3438557 5/2020
KR 20-1997-0006584 2/1997
(Continued)

OTHER PUBLICATIONS

Extended European Search Report dated Jul. 2, 2024 issued in Application No. 23199024.3.
(Continued)

*Primary Examiner* — Christopher R Zerphey
(74) *Attorney, Agent, or Firm* — KED & ASSOCIATES, LLP

(57) ABSTRACT

An outdoor unit of an air conditioner includes a base panel having first inlet and outlet holes; a compressor; a tank storing water exchanging heat with refrigerant discharged from the compressor; a pump supplying the water to the tank; a vertical panel having second inlet and outlet holes; a deaerator removing gas contained in the heat-exchanged water flowing from the tank; and pipes connected to the tank, the pump, and the deaerator, the pipes including a first pipe connected to an inlet of the pump; a second pipe connecting an outlet of the pump and the tank; a third pipe connecting that tank and an inlet of the deaerator; and a fourth pipe connected to an outlet of the deaerator; and the first pipe and the fourth being connectable to the inlet and outlet holes of either the vertical panel or the base panel.

20 Claims, 5 Drawing Sheets

(51) Int. Cl.

| | |
|---|---|
| ***F24F 1/26*** | (2011.01) |
| ***F24F 1/46*** | (2011.01) |
| ***F24F 1/56*** | (2011.01) |
| ***F24H 9/02*** | (2006.01) |
| ***F24H 9/14*** | (2006.01) |

(52) U.S. Cl.
CPC ..... *F24F 1/56* (2013.01); *F24H 9/02* (2013.01); *F24H 9/142* (2013.01); *F25B 2339/047* (2013.01)

(58) Field of Classification Search
CPC ..... F24F 1/42; F24F 1/46; F24F 1/60; F24F 1/62; F24F 1/64; F24F 1/66; F24F 1/68; F25B 2339/047; F24D 3/18
See application file for complete search history.

(56) References Cited

U.S. PATENT DOCUMENTS

| | | | | |
|---|---|---|---|---|
| 6,711,913 | B1 * | 3/2004 | Tung | B01D 53/0415 62/262 |
| 7,669,641 | B2 * | 3/2010 | Rembold | F24F 13/222 165/53 |
| 9,816,712 | B2 * | 11/2017 | Mochizuki | F24F 13/22 |
| 12,281,805 | B2 * | 4/2025 | Park | F24F 1/24 |
| 2013/0061616 | A1 * | 3/2013 | Zhang | F24H 4/02 62/84 |
| 2019/0264964 | A1 | 8/2019 | Suzuki et al. | |
| 2020/0173690 | A1 | 6/2020 | Takagi et al. | |
| 2022/0018580 | A1 * | 1/2022 | Kim | F24F 11/36 m |

FOREIGN PATENT DOCUMENTS

| | | |
|---|---|---|
| KR | 10-2004-0082664 | 9/2004 |
| KR | 10-2018-0040370 | 4/2018 |
| KR | 10-2022-0010865 | 1/2022 |
| WO | WO 2011/148102 | 12/2011 |
| WO | WO 2017/204063 | 11/2017 |
| WO | WO 2018/047265 | 3/2018 |

OTHER PUBLICATIONS

Korean Office Action dated Dec. 16, 2024, issued in Application No. 10-2023-0091330.

* cited by examiner

OUTDOOR UNIT OF AIR CONDITIONER

CROSS-REFERENCE TO RELATED APPLICATION(S)

The present application claims the benefits of priority to Korean Patent Application No. 10-2023-0091330, filed in Korea on Jul. 13, 2023, of which is incorporated herein by reference in their entireties.

BACKGROUND

1. Field

The present disclosure relates to an outdoor unit of an air conditioner.

2. Background

An air conditioner, also referred to as a heating, ventilation, and air conditioning system (HVAC), is a device that cools or heats and controls humidity levels in a room using a refrigerant. The air conditioner may have a refrigerant circulation system (also referred to as a refrigeration cycle) including, for example, a compressor, a condenser, an expansion valve, and an evaporator.

In one example, a high-temperature, high-pressure refrigerant discharged from the compressor may exchange heat with water or other liquid in a heat exchange device defined as a heat storage tank to supply heat to the water, and such an air conditioner may be defined as a heat storage type air conditioner (also referred to as an air to water heat pump). The heat storage type air conditioner is a device in which a refrigerant absorbs heat from air through the evaporator, is converted into a high-temperature and high-pressure refrigerant by the compressor, and then releases the heat into water in a heat storage tank. Accordingly, the heat storage type air conditioner may be understood as a device that receives heat from air and supplies the received heat and energy received from a compressor to water in the form of heat energy.

The heat storage type air conditioner may be divided into an indoor unit and an outdoor unit. For example, a fan and a heat exchanger may be accommodated in the indoor unit, and another fan, another heat exchanger, a compressor, and a heat storage tank may be accommodated in the outdoor unit.

An example of an outdoor unit constituting a conventional heat storage type air conditioner is provided in Korean Patent Publication No. 2022-0010865. This outdoor unit may include a connector for connecting an inlet-side water pipe extending from a heating facility and connected to the heat storage tank, and an outlet-side water pipe extending from the heat storage tank to the outside of the outdoor unit may be provided on a side or rear surface of the outdoor unit. Accordingly, the inlet-side water pipe and the outlet-side water pipe may be connected to the side or rear surface of the outdoor unit. In addition, the inlet-side water pipe and the outlet-side water pipe connecting the connector and the heat storage tank may be provided in the form of copper pipes, and the degree of freedom of connection of the copper pipes may be relatively low.

In certain regions, such as Europe, a connection portion of the hot water pipe for heating may be installed on a horizontal floor surface instead of on a vertical wall, such that a water pipe extends vertically from a water pipe connector at a side or rear of the outdoor unit to the connection portion at the floor. Therefore, the outdoor unit in which the water pipe connector is provided on the side or rear surface of the case may not be easily connected to the hot water pipe and may have an aesthetically undesirable appearance due to the exposed vertical water pipe.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a structure of an outdoor unit of an air conditioner according to an embodiment of the present disclosure will be described in detail with reference to the drawings.

Figure 1:
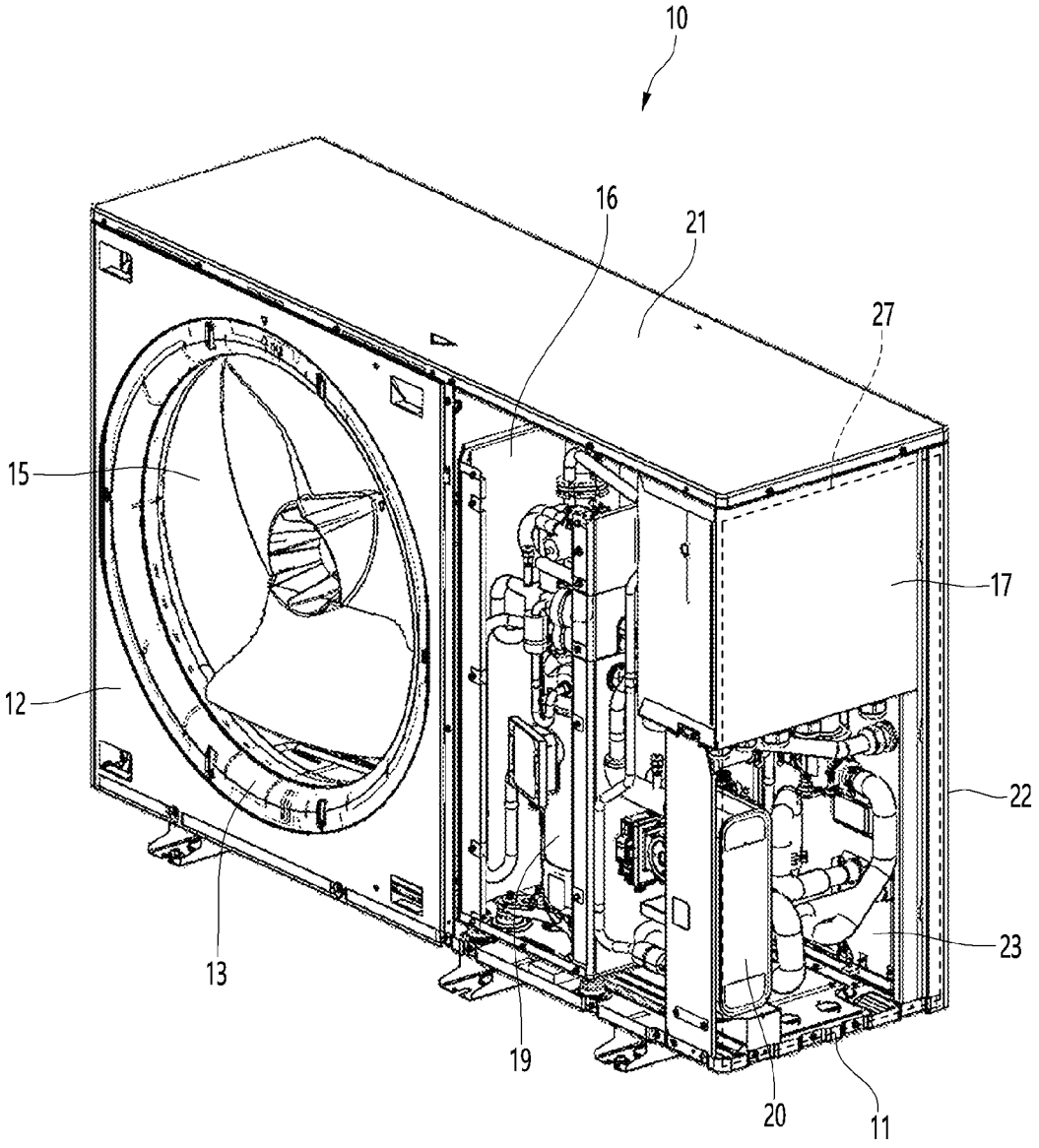
FIG. 1 is a front perspective view illustrating an outdoor unit of an air conditioner according to an embodiment of the present disclosure.
Figure 2:
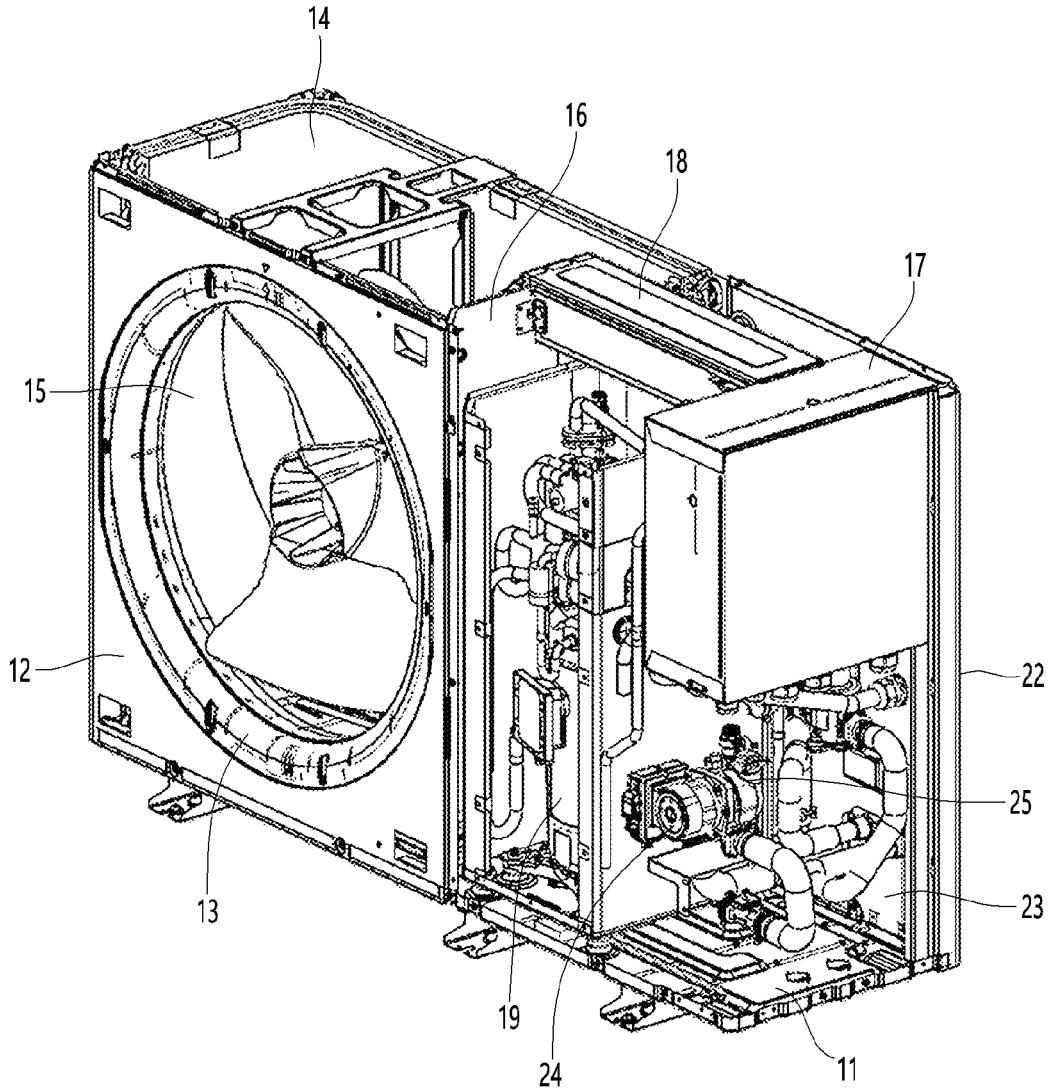
FIG. 2 is a front perspective view illustrating an outdoor unit in a state where a heat storage tank is removed.
Figure 3:
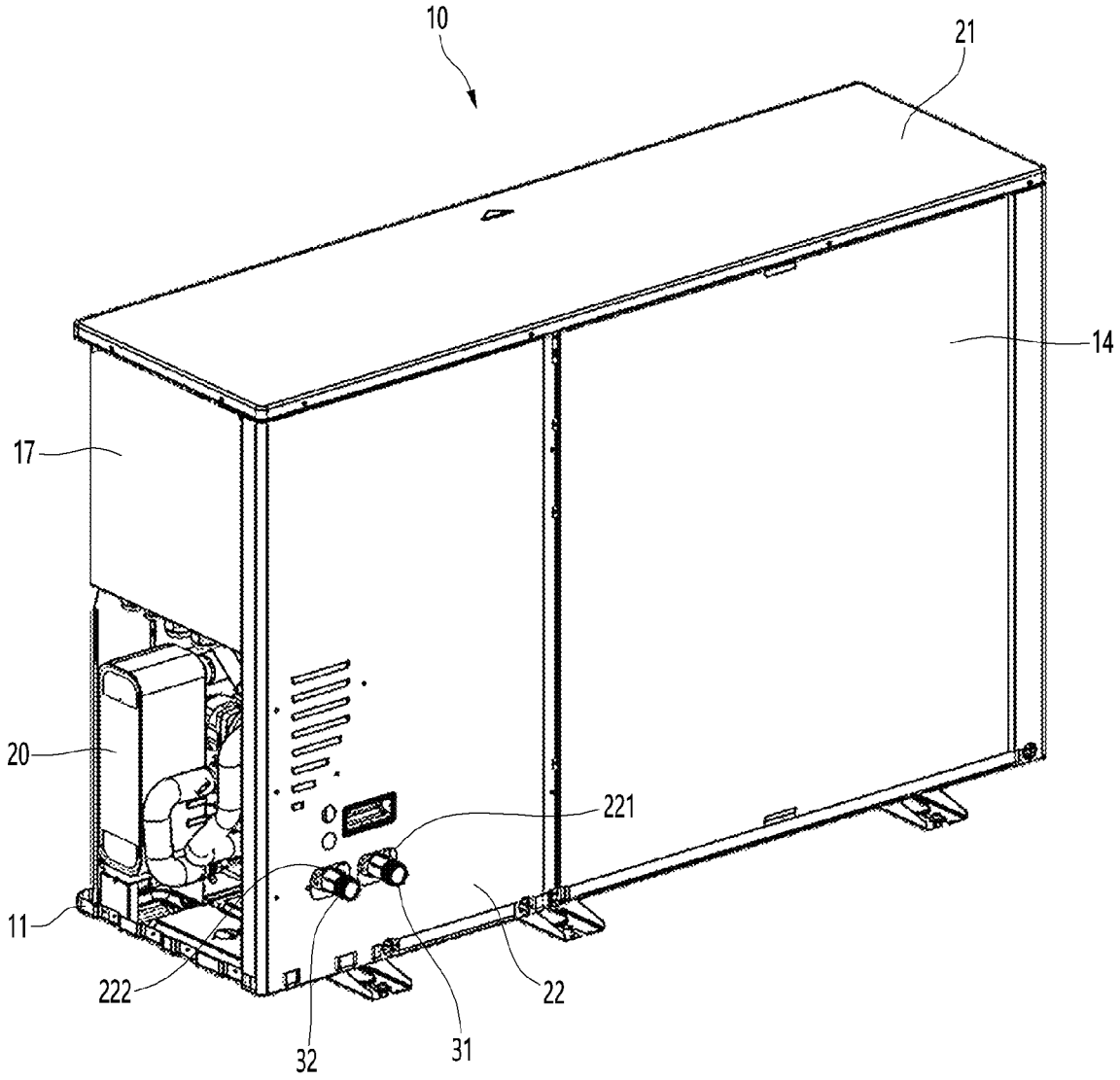
FIG. 3 is a rear perspective view state illustrating the outdoor unit.

FIG. 1 is a front perspective view illustrating an outdoor unit of an air conditioner according to an embodiment of the present disclosure, FIG. 2 is a front perspective view illustrating the outdoor unit in a state where a heat storage tank is removed, and FIG. 3 is a rear perspective view of the outdoor unit. Referring to FIGS. 1 to 3, an outdoor unit 10 of the air conditioner according to the embodiment of the present disclosure includes a base panel 11, a front panel 12 erected on the front end portion of the base panel 11, an orifice 13 provided in the front panel 12, a fan 15 placed on the rear side of the orifice 13, and a heat exchanger 14 erected on the upper surface of the base panel 11.

In one example, the outdoor unit 10 further includes a barrier 16 erected on an upper surface of the base panel 11. The barrier 16 may be understood as a partition member or wall that divides the upper space of the base panel 11 into a heat exchange space (shown at a left side in FIGS. 1-3) and an electrical portion space (shown at a right side in FIGS. 1-3). In addition, the heat exchanger 14 may be erected in the heat exchange space. In one example, the heat exchanger 14 may be bent into an L-shape that is extend along both the side end portion and the rear end portion of the base panel 11 to define the side surface and the rear surface of the heat exchange space.

One side end portion of the front panel 12 may be coupled to the front end portion of the heat exchanger 14, and the other side end portion of the front panel 12 may be coupled to the front end portion of the barrier 16. A rear end portion of the barrier 16 may be connected to a side end portion of the heat exchanger 14.

The outdoor unit 10 may further include a compressor 19 erected on a section of the upper surface of the base panel 11 corresponding to the electrical portion space. The outdoor unit 10 may further include a heat storage tank 20, and a control box placed in the upper space of the heat storage tank 20.

In one example, the heat storage tank 20 may be disposed at a point spaced apart from the compressor 19, and a flow path may be provided inside the heat storage tank 20 to allow a heat exchange between the refrigerant flowing within the flow both and water or other liquid within heat storage tank 20 without mixing the refrigerant and the water. In addition, a refrigerant flow path and a water flow path may be arranged to exchange heat inside the heat storage tank 20, and heat may be transferred from the refrigerant flowing along the refrigerant flow path to the water flowing along the water flow path. For example, the refrigerant, after passing through the compressor 19 to be heated and compressed, may flow into the heat storage tank 20 along the refrigerant pipe. A water pipe unit connected to the water flow path may be connected to the heat storage tank 20, and the water pipe unit will be described in detail with reference to the drawings below.

The refrigerant, after passing through the heat storage tank 20, may be guided to the heat exchanger 14 along the refrigerant pipe. The refrigerant, after passing through the heat exchanger 14, may be guided to the heat exchanger of an indoor unit. For example, refrigerant from the heater exchanger 14 may be guided toward the indoor unit after passing through an expansion valve. The refrigerant, after passing through the indoor unit, may return to the outdoor unit to the compressor 19. For example, the refrigerant may be guided toward the compressor 19 after passing through a gas-liquid separator.

When the fan 15 rotates, outside air may flow into the outdoor unit 10 and through the heat exchanger 14 to exchange heat with refrigerant within the heater exchanger 14. For example, outside air may flow through the short side of the heat exchanger 14 forming the side surface of the outdoor unit 10 and the long side of the heat exchanger 14 forming the rear surface of the outdoor unit 10. The air that has passed through the heat exchanger 14 may flow from the back side and to the front side of the fan 15, may then pass through the orifice 13, and then may be discharged back to the outside of the outdoor unit 10. In certain example, one or more of the blades constituting the fan 15 may be accommodated inside the orifice 13 so that substantially all of the air flowing by the fan 15 also passes through the orifice 13.

The outdoor unit 10 may further include a heat dissipation duct 18 extending between the control box 17 and the heat exchanger 14, a top cover 21 defining an upper surface of the outdoor unit 10, a back cover 22 defining a rear surface of the electrical space, a support panel 23 erected in front of the back cover 22 to support a connector (described later) of a water pipe unit, and a side panel 27 erected in a side end portion of the base panel 11. The side cover 27 and the back cover 22 may be defined as vertical panels.

The outdoor unit 10 may further include a pump 24 that supplies water or other liquid to the heat storage tank 20, and a deaerator 25 that removes air bubbles included in the water passing through the heat storage tank 20. For example, the deaerator 25 may heat water or generate a vacuum such that the water boils and releases gases, such as oxygen, which are pumped away or otherwise removed by the deaerator 25.

In an example depicted in FIG. 3, an inlet hole (or second inlet hole) 221 and an outlet hole (or second outlet hole) 222 may be formed in the back cover 22. An inlet connector 31 may be coupled to the inlet hole 221, and an outlet connector 32 may be coupled to the outlet hole 222.

Figure 4:
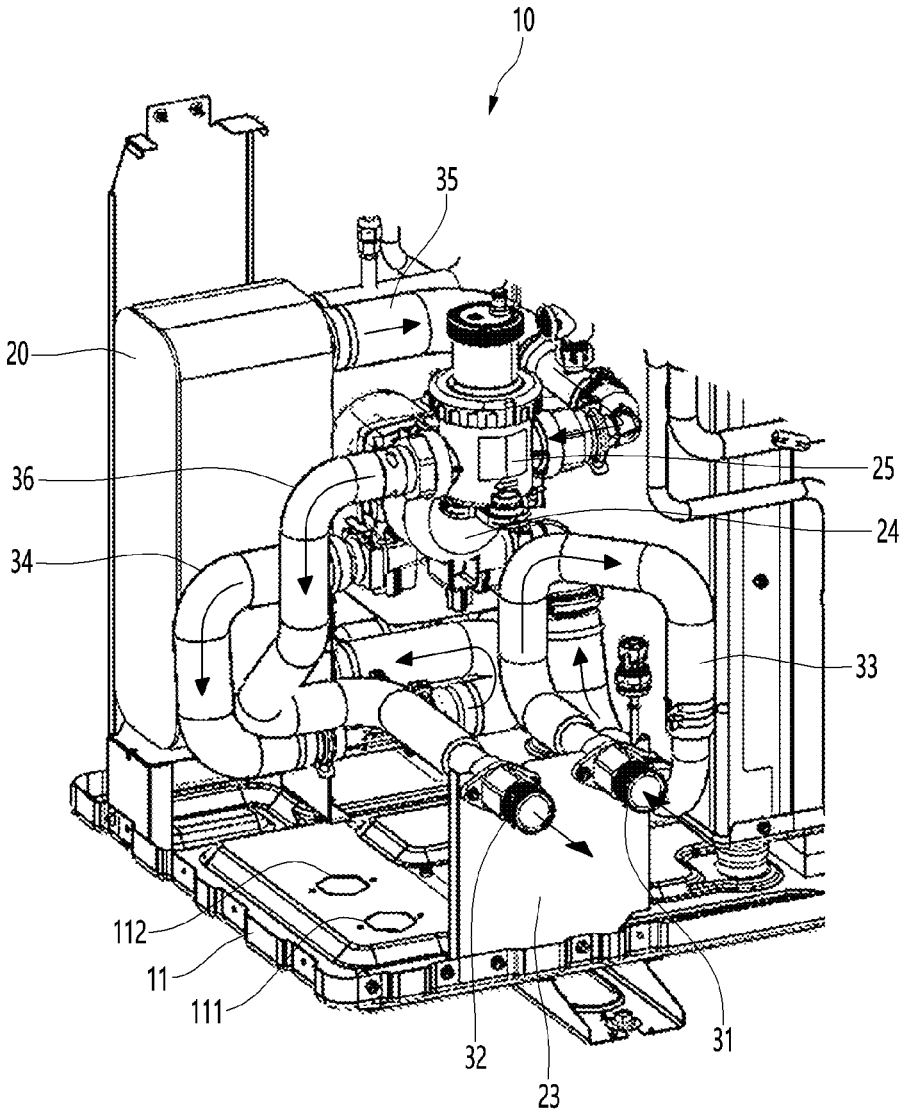
FIG. 4 is an enlarged perspective view of an outdoor unit illustrating a water pipe connection structure according to a first implementation.

FIG. 4 is an enlarged perspective view of an outdoor unit 10 illustrating a water pipe connection structure according to a first example. Referring to FIG. 4, an inlet hole (or first inlet hole) 111 and an outlet hole (or first outlet hole) 112 may be formed in a lower surface of the outdoor unit 10, such as in the base panel 11, and an the inlet hole 221 and the outlet hole 222 may be formed in a vertical side surface of the outdoor unit 10, such as the back panel 22 or a side panel (see FIG. 3). As described below, in the example shown in FIG. 4, inlet connector 31 and outlet connector 32 are provided at the inlet hole 221 and the outlet hole 222 to extend horizontally from a vertical surface, and away from the inlet hole 111 and the outlet hole 112.

The heat storage tank 20, the pump 24, the deaerator 25, and the water pipe unit may be disposed in a portion of the electrical space below the control box 17. For example, the water pipe unit may include a pump inlet pipe (or first pipe) 33 fluidly connecting the inlet connector 31 and an inlet of the pump 24, a pump outlet pipe (or second pipe) 34 fluidly connecting an outlet of the pump 24 and an inlet of the heat storage tank 20, a deaerator inlet pipe (or third pipe) 35 connecting an outlet of the heat storage tank 20 and an inlet of the deaerator 25, and a deaerator outlet pipe (or fourth pipe) 36 connecting an outlet of the deaerator 25 and the outflow connector 32. As described in greater detail below, at least one of the pipes 33-36 constituting the water piping unit may include flexible tubes made of rubber or silicon material so as to be flexible and easily bent.

In the example shown in FIG. 4, the inlet connector 31 and the outlet connector 32 may pass through the supporter panel 23 and the inlet hole 221 and the outlet hole 222 of the back cover 22. Thus, the inlet connector 31 and the outlet connector 32 may be exposed to the outside of the outdoor unit 10 through a side of the outdoor unit 10, such as a rear surface of the outdoor unit 10.

In addition, end portions of the heating pipe installed on the floor of the installation space may be connected to the inlet connector 31 and the outlet connector 32. Alternatively, the an outlet of a water supply pipe extending from a water source or a water faucet may be connected to the inlet connector 31, and an inlet of a hot water pipe may be connected to the outlet connector 32, so that hot water may be supplied to the user.

An inlet connector seating portion 231 on which the inflow connector 31 is seated and an outflow connector seating portion 232 on which the outlet connector 32 is seated may be formed at an upper end of the support panel 23. The inlet and outlet connector seating portions 231 and 232 may be provided, for example, in a hole that surrounds the inflow connector 31 or the outlet connector 32 or a groove that is provided around a portion of the inflow connector 31 or the outlet connector 32, such as to support a lower portion of the inflow connector 31 or the outlet connector 32.

Figure 5:
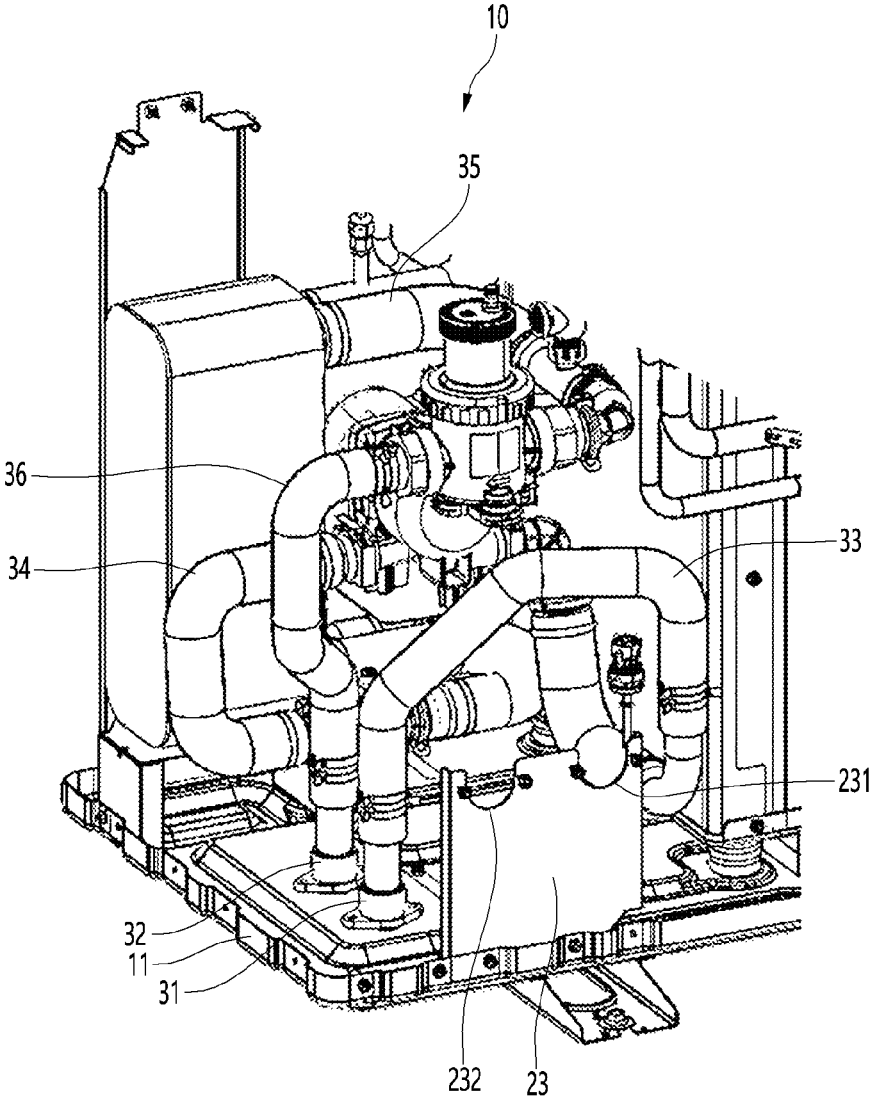
FIG. 5 is an enlarged perspective view of an outdoor unit illustrating a water pipe connection structure according to a second implementation.

FIG. 5 is an enlarged perspective view of the outdoor unit 10 illustrating a water pipe connection structure according to a second example of the present disclosure. Referring to FIG. 5, when the connection end portion of the heating pipe or the hot water pipe may be formed on the floor rather than the wall surface of the room, the inlet connector 31 and the outlet connector 32 may be connected to the inlet hole 111 and the outlet hole 112 formed in the base panel 11, as illustrated. As described below, in the example shown in FIG. 5, inlet connector 31 and outlet connector 32 are provided at the inlet hole 111 and the outlet hole 112 of the base panel 11 to extend vertically from a horizontal surface, and away from the inlet hole 221 and the outlet hole 222 on a vertical surface, such as the back panel 22.

To this end, the pump inlet pipe 33 and the deaerator outlet pipe 36 may be bent or otherwise modified so that the inlet connector 31 and the outlet connector 32 face the base panel 11 and are positioned to be coupled to inlet hole 111 and outlet hole 112. For example, the pump inlet pipe 33 and the deaerator outlet pipe 36 may be made of flexible tubes so that they can be bent.

In another example, a tube kit for wall installation and a tube kit for floor installation are provided separately, so that the kit matching the location of the water pipe which is connected to the inlet and outlet connectors 31, 32 may be used. For example, the shapes of the pump inlet pipe 33 and the deaerator outlet pipe 36 constituting the tube kit for wall installation may be manufactured differently from the shapes of the pump inlet pipe 33 and the deaerator outlet pipe 36 constituting the tube kit for floor installation.

Meanwhile, the inlet hole 221 and the outlet hole 222 may be formed in the side cover 27, and thus the supporter panel 23 may be erected at a side end portion of the base panel 11. In this way, the inlet and outlet connectors 31 and 32 may be connected to one of the floor surface, a side surface, or a rear surface of the outdoor unit 10.

An outdoor unit of an air conditioner according to an embodiment of the present disclosure may include a base panel in which an inlet hole and an outlet hole are formed; a compressor placed on the base panel; a heat storage tank having a refrigerant flow path through which the refrigerant discharged from the compressor flows and a water flow path for exchanging heat with the refrigerant flowing along the refrigerant flow path formed therein; a water pipe unit connected to the heat storage tank; a pump for supplying water to the heat storage tank; a vertical panel defining at least one of a side surface and a rear surface of the base panel and having an inlet hole and an outlet hole; a deaerator for removing air bubbles contained in the water passing through the heat storage tank, in which the water piping unit includes a pump inlet pipe having one end portion connected to an inlet of the pump; a pump outlet pipe connecting an outlet of the pump and an inlet of the water flow path; a deaerator inlet pipe connecting an outlet of the water flow path and an inlet of the deaerator; and a deaerator outlet pipe having one end portion connected to an outlet of the deaerator; and in which the other end portion of the pump inlet pipe and the other end portion of the deaerator outlet pipe are connectable to either a vertical panel or the base panel.

The outdoor unit of an air conditioner according to the present disclosure may further include an inlet connector connected to the other end portion of the pump inlet pipe; and an outlet connector connected to the other end portion of the deaerator outlet pipe. The inlet connector and the outlet connector may be mounted in the inlet hole and the outlet hole of the base panel, respectively. Alternatively, the inlet connector and the outlet connector may be mounted in the inlet hole and the outlet hole of the vertical panel, respectively.

The outdoor unit of an air conditioner according to the present disclosure may further include a support panel erected on an edge of the base panel corresponding to an inner side of the vertical panel to support the inlet connector and the outlet connector. A seating groove or a seating hole in which the inlet connector and the outlet connector are placed may be formed on the support panel.

The pump inlet pipe and the deaerator outlet pipe may include flexible tubes such that the other end portions of the pump inlet pipe and the deaerator outlet pipe are selectively connectable to either one of the vertical panel and the base panel in a state where one end portions of the pump inlet pipe and the deaerator outlet pipe are respectively connected to the inlet of the pump and the outlet of the deaerator. Shapes of the pump inlet pipe and the deaerator outlet pipe used when connected to the vertical panel may be different from shapes of the pump inlet pipe and the deaerator outlet pipe used when connected to the base panel. The vertical panel may include at least one of a side cover forming a side surface of the outdoor unit or a back cover forming a rear surface of the outdoor unit.

According to the outdoor unit of the air conditioner according to the embodiment of the present disclosure having the configuration as described above, it is possible to select one of the floor portion and the side surface (including the back surface) of the outdoor unit case as the mounting position of the water pipe connector, even if the water pipe for heating or hot water is extended through either the floor or the wall forming the space of the room, thereby facilitating service work for installation.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor unit of an air conditioner, the outdoor unit comprising:

a base panel placed on an installation surface having a first inlet hole and a first outlet hole;

a compressor;

a tank through which refrigerant discharged from the compressor and a liquid exchanging heat with the refrigerant flow;

pipes connected to the tank;

a pump that supplies the liquid to the tank;

a vertical panel defining at least one of a side surface or a rear surface of the outdoor unit and having a second inlet hole and a second outlet hole; and a deaerator that removes air bubbles contained in the liquid, wherein the pipes include:

a first pipe connected to an inlet of the pump;

a second pipe connecting an outlet of the pump and an inlet of the tank;

a third pipe connecting an outlet of the tank and an inlet of the deaerator; and a fourth pipe connected to an outlet of the deaerator; and wherein the first pipe and the fourth pipe are configured to be selectively connected to the second inlet hole and the second outlet hole of the vertical panel in a horizontal direction, or to the first inlet hole and the first outlet hole of the base panel in a vertical direction.

2. The outdoor unit of claim 1, further comprising:

an inlet connector connected to the first pipe; and an outlet connector connected to the fourth pipe.

3. The outdoor unit of claim 2, wherein the inlet connector and the outlet connector are mounted in the first inlet hole and the first outlet hole of the base panel, respectively, when the first pipe and the fourth pipe are connected at the base panel.

4. The outdoor unit of claim 1, wherein the inlet connector and the outlet connector are mounted in the second inlet hole and the second outlet hole of the vertical panel, respectively, when the first pipe and the fourth pipe are connected at the vertical panel.

5. The outdoor unit of claim 4, further comprising:

a support panel erected on an edge of the base panel and at an inner side of the vertical panel to support the inlet connector and the outlet connector.

6. The outdoor unit of claim 5, wherein the support panel includes at least one of a seating groove or a seating hole to receive each of the inlet connector and the outlet connector.

7. The outdoor unit of claim 1, wherein the first pipe and the fourth pipe include flexible sections such that first ends the first pipe and the fourth pipe are selectively connectable at either one of the vertical panel or the base panel when second ends of the first pipe and the fourth pipe are respectively connected to the inlet of the pump and the outlet of the deaerator.

8. The outdoor unit of claim 1, wherein shapes of the first pipe and the fourth pipe when connected at the vertical panel are different from the shapes of the first pipe and the fourth pipe when connected at the base panel.

9. The outdoor unit of claim 1, wherein the vertical panel includes at least one of:

a side cover forming at least a portion of the side surface of the outdoor unit; or a back cover forming at least a portion of the rear surface of the outdoor unit.

10. The outdoor unit of claim 1, wherein the compressor is placed on the base panel.

11. An outdoor unit of an air conditioner, the outdoor unit comprising:

a compressor;

a tank through which refrigerant discharged from the compressor and a liquid exchanging heat with the refrigerant flow;

pipes connected to the tank;

a pump that supplies the liquid to the tank;

a deaerator that removes air bubbles contained in the liquid; and a housing having a horizontal bottom surface placed on an installation surface and a vertical surface extending upward from the bottom surface, the bottom surface including a first inlet hole and a first outlet hole, and the vertical surface including a second inlet hole and a second outlet hole provided above first inlet hole, wherein the pipes include:

a first pipe connected to an inlet of the pump;

a second pipe connecting an outlet of the pump and an inlet of the tank;

a third pipe connecting an outlet of the tank and an inlet of the deaerator; and a fourth pipe connected to an outlet of the deaerator; and wherein the first pipe and the fourth pipe are configured to be selectively connected to the second inlet hole and the second outlet hole of the vertical surface in a horizontal direction, or to the first inlet hole and the first outlet hole of the bottom surface in a vertical direction.

12. The outdoor unit of claim 11, further comprising:

an inlet connector connected to the first pipe; and an outlet connector connected to the fourth pipe.

13. The outdoor unit of claim 12, wherein the inlet connector and the outlet connector are mounted in the first inlet hole and the first outlet hole, respectively, when the first pipe and the fourth pipe are connected through the first inlet hole and the first outlet hole.

14. The outdoor unit of claim 11, wherein the inlet connector and the outlet connector are mounted in the second inlet hole and the second outlet hole, respectively, when the first pipe and the fourth pipe are connected at the second inlet hole and the second outlet hole.

15. The outdoor unit of claim 14, further comprising:

a support panel erected at an inner vertical surface of the housing to support the inlet connector and the outlet connector.

16. The outdoor unit of claim 15, wherein the support panel includes at least one of a seating groove or a seating hole to receive each of the inlet connector and the outlet connector.

17. The outdoor unit of claim 11, wherein the first pipe and the fourth pipe include flexible sections such that first ends the first pipe and the fourth pipe are selectively connectable either to the first inlet hole and the first outlet hole or to the second inlet hole and the second outlet hole when second ends of the first pipe and the fourth pipe are respectively connected to the inlet of the pump and the outlet of the deaerator.

18. The outdoor unit of claim 11, wherein shapes of the first pipe and the fourth pipe when connected at the first inlet hole and the first outlet hole are different from the shapes of the first pipe and the fourth pipe when connected at the second inlet hole and the second outlet hole.

19. The outdoor unit of claim 11, wherein the vertical surface includes at least one of:

a side cover forming at least a portion of a side surface of the outdoor unit; or a back cover forming at least a portion of a rear surface of the outdoor unit.

20. The outdoor unit of claim 11, wherein the bottom surface includes a base panel, and the compressor is placed on the base panel.

* * * * *